US005831204A

United States Patent [19]

Lübben et al.

[11] Patent Number: 5,831,204

[45] Date of Patent: Nov. 3, 1998

[54] PROPELLANT IGNITER ASSEMBLY HAVING A MULTI-ZONE BOOSTER CHARGE

[75] Inventors: Manfred Lübben, Celle; Stefan Thiesen, Willich; Walter Simon, Herzogenrath; Dieter Jungbluth, Herschbach, all of Germany

[73] Assignee: Rheinmetall Industrie Aktiengesellschaft, Ratingen, Germany

[21] Appl. No.: 753,804

[22] Filed: Dec. 2, 1996

[30] Foreign Application Priority Data

Dec. 1, 1995 [DE] Germany ..... 195 44 823.5

[51] Int. Cl.[6] ..... C06C 5/04; F42B 3/00

[52] U.S. Cl. ..... 102/318; 102/275.4

[58] Field of Search ..... 102/318, 275.4

[56] References Cited

U.S. PATENT DOCUMENTS

| | | | |
|---|---|---|---|
| 4,179,992 | 12/1979 | Ramnarace et al. | 102/45 |
| 4,270,455 | 6/1981 | Janoski | 102/318 |
| 4,331,081 | 5/1982 | Cloutier et al. | 102/318 |
| 4,411,199 | 10/1983 | Yates et al. | 102/481 |
| 4,616,566 | 10/1986 | Yates, Jr. | 102/318 |
| 4,742,773 | 5/1988 | Bartholomew et al. | 102/275.3 |
| 4,879,952 | 11/1989 | Dowing et al. | 102/331 |
| 5,180,883 | 1/1993 | Jaskolka et al. | 102/443 |
| 5,597,974 | 1/1997 | Voreck, Jr. et al. | 102/318 X |

*Primary Examiner*—Peter A. Nelson
*Attorney, Agent, or Firm*—Spencer & Frank

[57] ABSTRACT

A propellant igniter assembly includes a housing having ignition channels for the passage of an ignition flame through the housing; an igniter part accommodated in the housing; and a booster part accommodated in the housing and frontally adjoining the igniter part. The booster part has a booster charge which includes a first partial booster charge adjoining the igniter part and composed of a readily ignitable substance and a second partial booster charge adjoining the first partial booster charge and being separated thereby from the igniter part. The second partial booster charge entirely obturates all the ignition channels. The second partial booster charge has a burning behavior and a mechanical stability such that the ignition channels remain obturated for a short duration even after ignition of the second partial booster charge, whereby a firing impact is first retained in the booster part and is subsequently abruptly released in a concentrated form through the ignition channels.

27 Claims, 1 Drawing Sheet

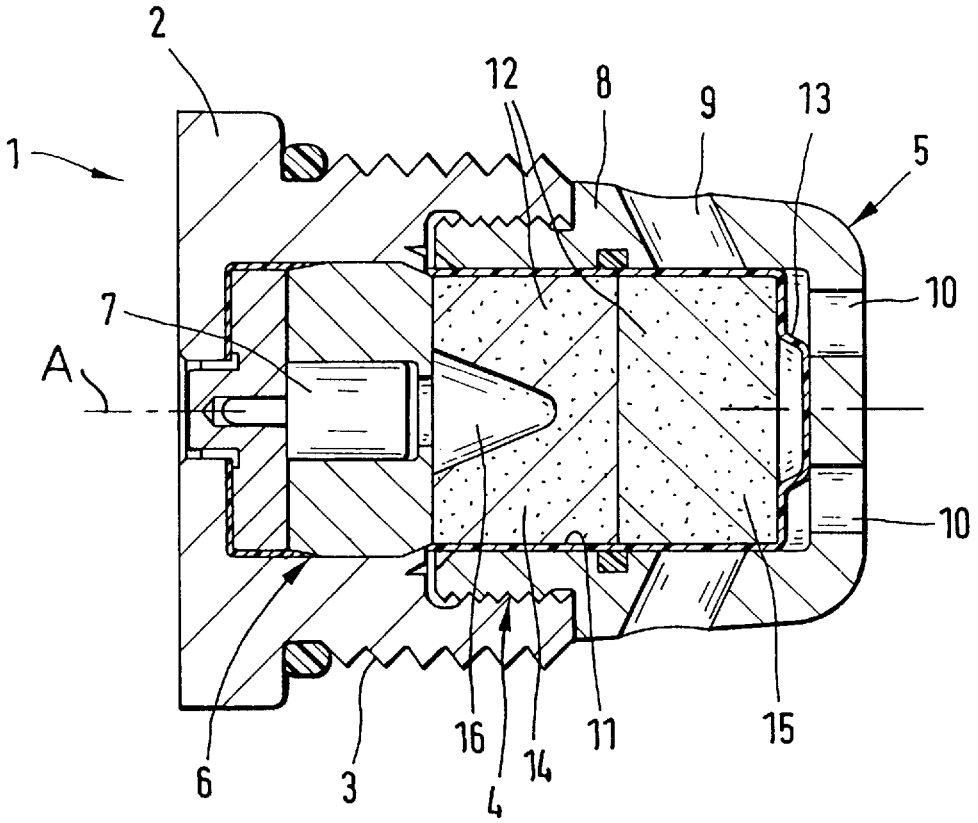
2
1
12
8
9
13
5
10
7
A
10
6
3
16
4
14
11
15

PROPELLANT IGNITER ASSEMBLY HAVING A MULTI-ZONE BOOSTER CHARGE

CROSS REFERENCE TO RELATED APPLICATION

This application claims the priority of German Application No. 195 44 823.5 filed Dec. 1, 1995, which is incorporated herein by reference.

BACKGROUND OF THE INVENTION

This invention relates to a propellant igniter assembly for ammunition and is of the type that has a housing, an igniter part accommodated in the housing and a booster part frontally adjoining the housing. The booster part includes a booster charge and a wall which surrounds the booster charge and which is provided with approximately radial and/or axial igniting ports (channels) relative to the assembly axis.

Propellant igniter assemblies, particularly for large-caliber ammunition, include a housing which has an igniter part and which can be screwed into the cartridge bottom and a booster part frontally adjoining the housing. In most cases, the igniter part is an electric igniter. The electrically initiated ignition pulse generates an ignition flame which continuously propagates in the booster part while being rendered increasingly more powerful by a booster charge. The ignition flame passes through an ignition distributor having approximately radial and axial ignition channels and penetrates the propellant or affects an auxiliary charge inserted in-between.

The transit time which can be measured by the ignition delay time ($t_4$-time), should be as short as possible and should be below 40 ms. As a condition to obtain such a result, the speed of ignition and propagation has to be very high and must be boosted so that a sufficiently large amount of energy can be transmitted to the propellant during the transit time. This problem can only be solved with the aid of an ignition booster associated with the igniter part.

While propellant igniters are known which have the required short ignition delay times, such igniters, however, are not designed on the basis of black powder. These igniters comprise booster charges which, compared to a black powder-containing booster, have a higher reaction speed and a higher combustion temperature and thus allow for a rapid flame transmission.

SUMMARY OF THE INVENTION

It is an object of the invention to provide a black powder-based propellant igniter assembly which attains ignition delay times below 40 ms.

This object and others to become apparent as the specification progresses, are accomplished by the invention, according to which, briefly stated, the propellant igniter assembly includes a housing having ignition channels for the passage of an ignition flame through the housing; an igniter part accommodated in the housing; and a booster part accommodated in the housing and frontally adjoining the igniter part. The booster part has a booster charge which includes a first partial booster charge adjoining the igniter part and composed of a readily ignitable substance and a second partial booster charge adjoining the first partial booster charge and being separated thereby from the igniter part. The second partial booster charge entirely obturates all the ignition channels. The second partial booster charge has a burning behavior and a mechanical stability such that the ignition channels remain obturated for a short duration even after ignition of the second partial booster charge, whereby a firing impact is first retained in the booster part and is subsequently abruptly released in a concentrated form through the ignition channels.

According to the invention, the short ignition time is achieved in a black powder-based propellant igniter assembly by virtue of its construction and by a zone-wise change in the chemical composition of the booster charge. Advantageously, from the composition of the type of black powder and from its properties the high ignition sensitivity is utilized and the rapid combustion rate is selected already at a low pressure level. Additionally, a gas formation rate occurs which is controlled according to the invention by virtue of the fact that the booster charge is constructed in zones and produces partially a moderate and partially a high gas yield.

Advantageously, the zones are formed by pellets which together constitute the booster charge. The pellet representing a first zone (or first partial charge) has one type of chemical substance, whereas an adjoining pellet representing a second zone (or second partial charge) has a different type of chemical composition. As a result, the zones or pellets of the booster charge have different functions. The first pellet (first partial charge) which faces the igniter part, is intended to be ignited throughout by the ignition flame of the igniter part without delay. For this purpose, the first pellet has a conical recess. Such a configuration presents an enlarged ignition surface as well as a sufficient space for fragmenting the pellet into extremely small burning pieces during the ignition impact. The second zone (second pellet) which is already ignited at this time but which initially has a blocking effect, holds together the burning fragments. This is possible because a gas pressure has been built up which is not yet excessively high. This gas pressure is the prerequisite for the rapid combustion of the second zone or pellet.

Particularly granulated black powder is suited as a material for the first partial charge. The pellet into which the material is pressed is sufficiently strong, and fragments are generated which attain a sufficiently long combustion time if the grain size is set at 0.2–1.5 mm, preferably between 0.3–1.2 mm.

Because of the shattering and rapid ignition of the first partial charge, the flame reaches the second zone or second partial charge practically without delay and ignites it at its end face. The second partial charge fully covers the ignition channels provided in the housing wall surrounding the booster charge and initially maintains them closed. The mechanical stability and shape of the second zone (second partial charge) are such that it withstands the ignition impact and the fragmenting derived from the first partial charge or offers a high resistance. Therefore, the second partial charge first retains the firing impact and then suddenly releases it by the generated pressure so that an instantaneous flame propagation takes place through the ignition channels towards the propellant powder.

The second partial charge preferably is made of a firmly pressed mixture of black powder grains and nitrocellulose. In order to accomplish optimum ignition delay times ($t_4$<40 ms) with the described structure of the booster charge, a nitrocellulose having a nitrogen content of 12.0–12.5% (collodion cotton) is sufficient. The fibrous nitrocellulose acts as a binder and increases the strength of the booster pellet. During combustion, the second partial booster charge provides for a temperature and pressure increase.

The second partial charge is preferably made of a mixture of 7–25% by weight—preferably 15–20% by weight—nitrocellulose with grained black powder and should additionally contain an antifriction agent, such as graphite. The graphite promotes the precision of dosing and reduces the friction during the pressing process. The graphite, however, adversely affects the ignition process, since it does not take part in the combustion. Accordingly, it consumes energy and does not contribute to the ignition transmission due to the small particle sizes. The graphite proportion must therefore be minimized and should be below 1% by weight.

The mixing of black powder with nitrocellulose couples the ignition sensitivity and rapid flame propagation of the black powder with the rapid combustion rate of the nitrocellulose when a high pressure level is reached. This condition occurs after ignition and once the combustion of the first partial charge has started, because the second partial charge itself blocks the pressure relief, that is, it maintains the ignition channels (ports) closed and thus provides for the necessary pressure increase in the volume of the first partial charge. Such a pressure increase prepares for a rapid reaction of the second partial charge.

Owing to the nitrocellulose content, the second partial charge generates an increased proportion of hot propellant gases during its combustion; these propellant gases accelerate the burning black powder particles under pressure out of the first and second partial charges through the opened ignition channels, resulting in a rapid ignition of the propellant.

According to a particularly advantageous feature of the invention, the partial charges are arranged in the booster part in a cylindrical plastic capsule made from polyethylene (PE) or polypropylene (PP) or from EPDM rubber. Even if thin-walled, capsules made from such materials constitute a reliable barrier against moisture, water and other migrating substances from, for example, the propellant powder.

While in known propellant igniters the booster charge is also encapsulated to protect it from moisture and/or other external effects, such conventional capsules are made from metal, usually aluminum. Aluminum capsules, however, have several disadvantages because during ignition the aluminum capsule is punched through at the ignition channels. The aluminum particles obtained during such an occurrence are hurled, while burning, into the weapon chamber. When the breechblock is opened and thus air is admitted to the weapon chamber, the aluminum particles that are not totally burnt or are covered by oxide layers, may flare up again in the presence of ignitable residual gases (after-ignition). In some instances, a new cartridge introduced into the weapon chamber might even be accidentally ignited by such a conventional igniter in the region of the burning capsule material. Thus, aluminum capsules present an increased safety risk which is avoided when plastic capsules of the above-discussed type are used.

BRIEF DESCRIPTION OF THE DRAWING

The sole FIGURE is an axial sectional view of a preferred embodiment of the invention.

DESCRIPTION OF THE PREFERRED EMBODIMENTS

The FIGURE shows a propellant igniter assembly generally designated at 1 for large-caliber cartridges. Such igniter assemblies are usually screwed into the metal bottom of the cartridge which may have a combustible case.

The propellant igniter assembly 1 includes a housing 2 having an external thread 3 and a booster part 5 which is frontally connected to the housing 2 by a screw connection 4. The housing 2 accommodates an igniter part 6 which is of conventional construction and which includes a detonator 7.

The booster part 5 includes a hood-like booster housing 8, whose wall is provided with ignition channels 9 which are radial or oblique relative to the assembly axis A as well as forwardly-oriented axial ignition channels 10 which, however, may be omitted. In the interior chamber 11 of the booster section 5 a booster charge 12 is disposed which is composed of at least two axially adjoining partial charges (zones) 14 and 15 constituted by pressed pellets. The booster charge 12 is protected against moisture by a plastic capsule 13.

The first partial charge 14 which adjoins the igniter part 6 has a funnel-shaped recess 16 on its side flaring toward and facing the igniter part 6. The pellet forming the partial charge 14 is composed of pressed black powder to which a binder in a proportion of 1 to 5% by weight may be admixed in order to optionally increase the mechanical strength of the pellet 14.

The second partial charge 15 is arranged such that it covers the ignition channels 9 and 10. In addition to black powder, the second partial charge 15 comprises a higher proportion of 20±5% by weight (dry) nitrocellulose (NC). Such an NC proportion suffices for minimizing the ignition delay time to values below 40 ms, even at low temperatures (−40° C.). Instead of nitrocellulose, nitroguanidine can also be used; in such a case the proportion of nitroguanidine should likewise be approximately 20% by weight to obtain ignition delay times $\leqq 40$ ms. The admixture of nitrocellulose, however, has proven to be particularly advantageous since nitrocellulose acts as a binder and considerably strengthens the pellet.

Further, it is feasible to form the second partial charge 15 of a nitrocellulose component powder, by which a nitrocellulose/black powder combination without sulphur is meant. Such component powders are characterized by a combustion rate which is as rapid as that of a nitrocellulose/black powder mixture, if the pressure and temperature conditions are in the favorable range. In pressed form, such component powders are very well suited as a booster charge. In a preferred embodiment with a nitrocellulose component powder S 5360, the nitrocellulose and nitrogen proportions amount to 40% by weight and 13.1% by weight, respectively.

In order to prevent the occurrence of safety-relevant problems (for example, unintended ignition during the pressing process) during mass production of the partial charges and their subsequent handling, it proved to be useful to mix very small amounts of graphite into the compositions. The graphite has a stabilizing effect during the processing and improves the sliding friction during the pressing process.

Particularly in cartridges where the propellant igniter assembly 1 is surrounded by an annular auxiliary charge, it has been found to be advantageous to omit the axial ignition channels 10 from the booster housing 8. Such an arrangement directs more ignition energy onto the annular auxiliary charge through the ignition channels 9 which form an angle other than zero with the assembly axis A. By virtue of the increased confinement in the propellant igniter assembly, the pressure is increased and promotes the rapid combustion reaction of the nitrocellulose portion in the partial charge 15. As a result, the ignition delay time is further decreased.

It will be understood that the above description of the present invention is susceptible to various modifications, changes and adaptations, and the same are intended to be comprehended within the meaning and range of equivalents of the appended claims.

What is claimed is:

1. A propellant igniter assembly comprises (a) a housing including ignition channels for the passage of an ignition flame through said housing;

(b) an igniter part accommodated in said housing; and (c) a booster part accommodated in said housing and adjoining said igniter part; said booster part including a booster charge having (1) a first partial booster charge adjoining said igniter part and composed of a readily ignitable substance; and (2) a second partial booster charge adjoining said first partial booster charge and being separated thereby from said igniter part; said second partial booster charge entirely obturating all said ignition channels; said second partial booster charge being composed of a uniform component powder made of black powder-nitrocellulose and having a burning behavior and a mechanical stability such that said ignition channels remain obturated for a short duration even after ignition of said second partial booster charge, whereby a firing impact is first retained in said booster part and is subsequently abruptly released in a concentrated form through said ignition channels.

2. The propellant igniter assembly as defined in claim 1, wherein said first partial booster charge has an end face oriented toward said igniter part and further wherein said first partial booster charge has a funnel-shaped recess flaring toward and open at said end face.

3. The propellant igniter assembly as defined in claim 1, wherein said booster charge is compressed in zones.

4. The propellant igniter assembly as defined in claim 1, further comprising an assembly axis; said igniting channels being oriented to said assembly axis at an angle other than zero.

5. The propellant igniter assembly as defined in claim 1, wherein said first partial booster charge is made of compressed black powder.

6. The propellant igniter assembly as defined in claim 5, wherein said black powder has a grain size between 0.2 and 1.5 mm.

7. The propellant igniter assembly as defined in claim 5, wherein said black powder has a grain size between 0.3 and 1.2 mm.

8. The propellant igniter assembly as defined in claim 5, wherein said first partial booster charge includes a binder in a proportion of 1 to 5% by weight.

9. The propellant igniter assembly as defined in claim 1, further comprising a plastic capsule containing said booster charge.

10. The propellant igniter assembly as defined in claim 9, wherein said plastic capsule is composed of a material selected from a group consisting of polyethylene, polypropylene, a mixture polymer of polyethylene and polypropylene and EPDM rubber.

11. A propellant igniter assembly comprises (a) a housing including ignition channels for the passage of an ignition flame through said housing;

(b) an igniter part accommodated in said housing; and (c) a booster part accommodated in said housing and adjoining said igniter part; said booster part including a booster charge having (1) a first partial booster charge adjoining said igniter part and composed of a readily ignitable substance; and (2) a second partial booster charge adjoining said first partial booster charge and being separated thereby from said igniter part; said second partial booster charge entirely obturating all said ignition channels; said second partial booster charge being composed of a mixture of blackpowder grains and one of nitrocellulose fibers and nitroguanidine; said second partial booster charge having a burning behavior and a mechanical stability such that said ignition channels remain obturated for a short duration even after ignition of said second partial booster charge, whereby a firing impact is first retained in said booster part and is subsequently abruptly released in a concentrated form through said ignition channels.

12. The propellant igniter assembly as defined in claim 11, wherein said nitrocellulose has a nitrogen content of 12.0–12.5%.

13. The propellant igniter assembly as defined in claim 11, wherein said nitrocellulose is present in a proportion of about 40% by weight.

14. The propellant igniter assembly as defined in claim 11, wherein said first partial booster charge has an end face oriented toward said igniter part and further wherein said first partial booster charge has a funnel-shaped recess flaring toward and open at said end face.

15. The propellant igniter assembly as defined in claim 11, wherein said nitrocellulose is present in a proportion of 7–25% by weight.

16. The propellant igniter assembly as defined in claim 11, wherein said nitrocellulose is present in a proportion of 15–20% by weight.

17. The propellant igniter assembly as defined in claim 11, wherein said nitroguanidine is present in a proportion of 7–25% by weight.

18. The propellant igniter assembly as defined in claim 11, wherein said nitroguanidine is present in a proportion of 15–20% by weight.

19. The propellant igniter assembly as defined in claim 11, wherein said nitrocellulose has a nitrogen content of 12.0–12.5%.

20. The propellant igniter assembly as defined in claim 11, wherein said booster charge is compressed in zones.

21. The propellant igniter assembly as defined in claim 11, further comprising an assembly axis; said igniting channels being oriented to said assembly axis at an angle other than zero.

22. The propellant igniter assembly as defined in claim 11, wherein said first partial booster charge is made of compressed black powder.

23. The propellant igniter assembly as defined in claim 17, wherein said black powder has a grain size between 0.2 and 1.5 mm.

24. The propellant igniter assembly as defined in claim 17, wherein said black powder has a grain size between 0.3 and 1.2 mm.

25. The propellant igniter assembly as defined in claim 17, wherein said first partial booster charge includes a binder in a proportion of 1 to 5% by weight.

26. The propellant igniter assembly as defined in claim 11, further comprising a plastic capsule containing said booster charge.

27. The propellant igniter assembly as defined in claim 21, wherein said plastic capsule is composed of a material selected from a group consisting of polyethylene, polypropylene, a mixture polymer of polyethylene and polypropylene and EPDM rubber.

* * * * *